US009282389B1

(12) United States Patent
Khenkin et al.

(10) Patent No.: US 9,282,389 B1
(45) Date of Patent: Mar. 8, 2016

(54) MICROELECTROMECHANICAL SYSTEMS DEVICE OPTIMIZED FOR FLIP-CHIP ASSEMBLY AND METHOD OF ATTACHING THE SAME

(71) Applicant: INVENSENSE, INC., San Jose, CA (US)

(72) Inventors: Aleksey S. Khenkin, Nashua, NH (US); Anthony D. Minervini, Palo Hills, IL (US); Kieran P. Harney, Andover, MA (US)

(73) Assignee: INVENSENSE, INC., San Jose, CA (US)

( * ) Notice: Subject to any disclaimer, the term of this patent is extended or adjusted under 35 U.S.C. 154(b) by 22 days.

(21) Appl. No.: 14/461,643

(22) Filed: Aug. 18, 2014

(51) Int. Cl.
*H04R 1/08* (2006.01)

(52) U.S. Cl.
CPC ..... *H04R 1/08* (2013.01); *H04R 2201/003* (2013.01)

(58) Field of Classification Search
None
See application file for complete search history.

(56) References Cited

U.S. PATENT DOCUMENTS

2014/0037120 A1* 2/2014 Lim ..... H04R 23/00 381/355
2014/0064546 A1* 3/2014 Szczech ..... H04R 1/04 381/361
2015/0102390 A1* 4/2015 Liu ..... H01L 27/092 257/254

* cited by examiner

*Primary Examiner* — Paul Huber
(74) *Attorney, Agent, or Firm* — Amin, Turocy & Watson, LLP

(57) ABSTRACT

A microelectromechanical systems (MEMS) device optimized for flip-chip assembly and method of attaching the same are presented herein. A device can include a substrate, an acoustic seal, and a MEMS device mechanically attached to the substrate utilizing bond pad(s) that electrically couple the MEMS device to the substrate and/or an application-specific integrated circuit (ASIC). A portion of the MEMS device includes an acoustic area, an acoustic seal area that surrounds the acoustic area and includes the acoustic seal, and electrical interconnect area(s) that are located outside of the acoustic seal area and include the bond pad(s). The acoustic seal can be compressed between the acoustic seal area and the substrate and/or the ASIC, and include a thixotropic adhesive material. Mechanical support(s) that define a gap between the MEMS device and the substrate and/or the ASIC can be attached to the acoustic seal area and/or the substrate.

23 Claims, 13 Drawing Sheets

MICROELECTROMECHANICAL SYSTEMS DEVICE OPTIMIZED FOR FLIP-CHIP ASSEMBLY AND METHOD OF ATTACHING THE SAME

TECHNICAL FIELD

This disclosure generally relates to embodiments for a microelectromechanical systems (MEMS) device optimized for flip-chip assembly and method of attaching the same.

BACKGROUND

Conventional MEMS device technologies bond a MEMS die, e.g., a MEMS microphone, a MEMS speaker, etc. to a substrate and subsequently apply a sealant around a perimeter of the MEMS die to seal gap(s) formed between the MEMS die and the substrate. In this regard, portions of the sealant flow into membrane area(s) of the MEMS die and/or electrical interconnect area(s) of the MEMS die. Consequently, conventional MEMS device technologies have had some drawbacks, some of which may be noted with reference to the various embodiments described herein.

BRIEF DESCRIPTION OF THE DRAWINGS

Non-limiting embodiments of the subject disclosure are described with reference to the following figures, wherein like reference numerals refer to like parts throughout the various views unless otherwise specified.

DETAILED DESCRIPTION

Figure 1:
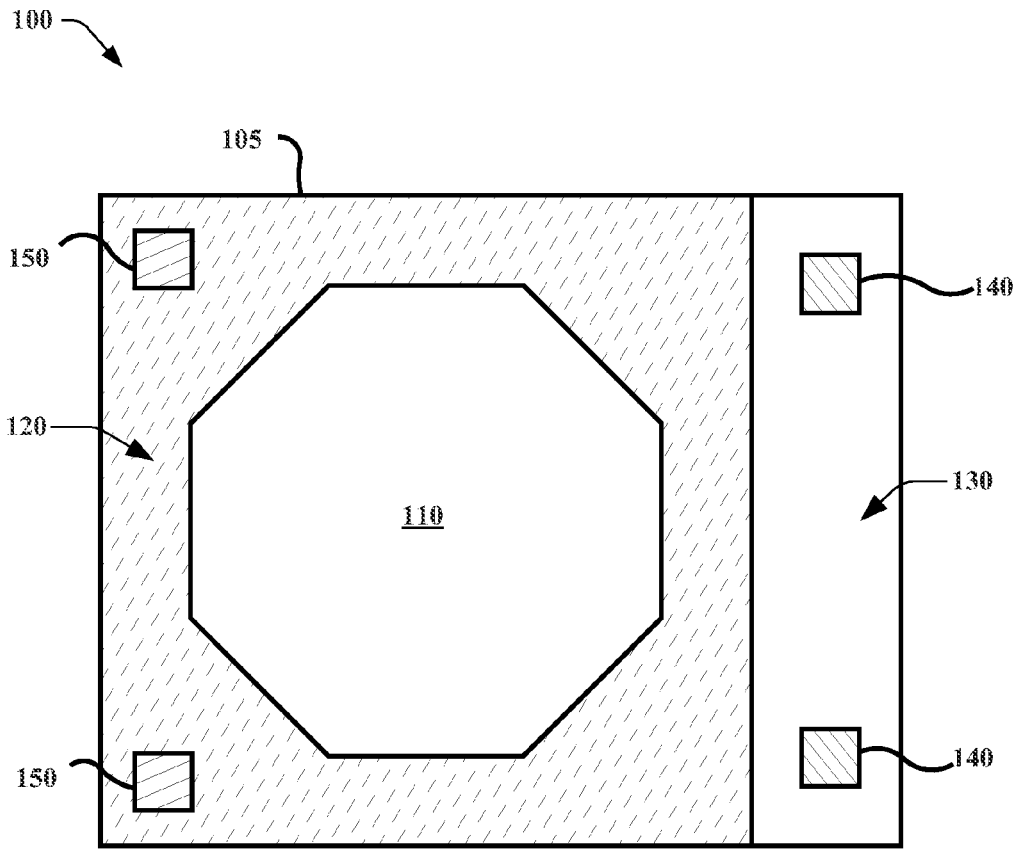
FIG. 1 illustrates a block diagram of a bottom view of a MEMS device, in accordance with various embodiments.
Figure 2:
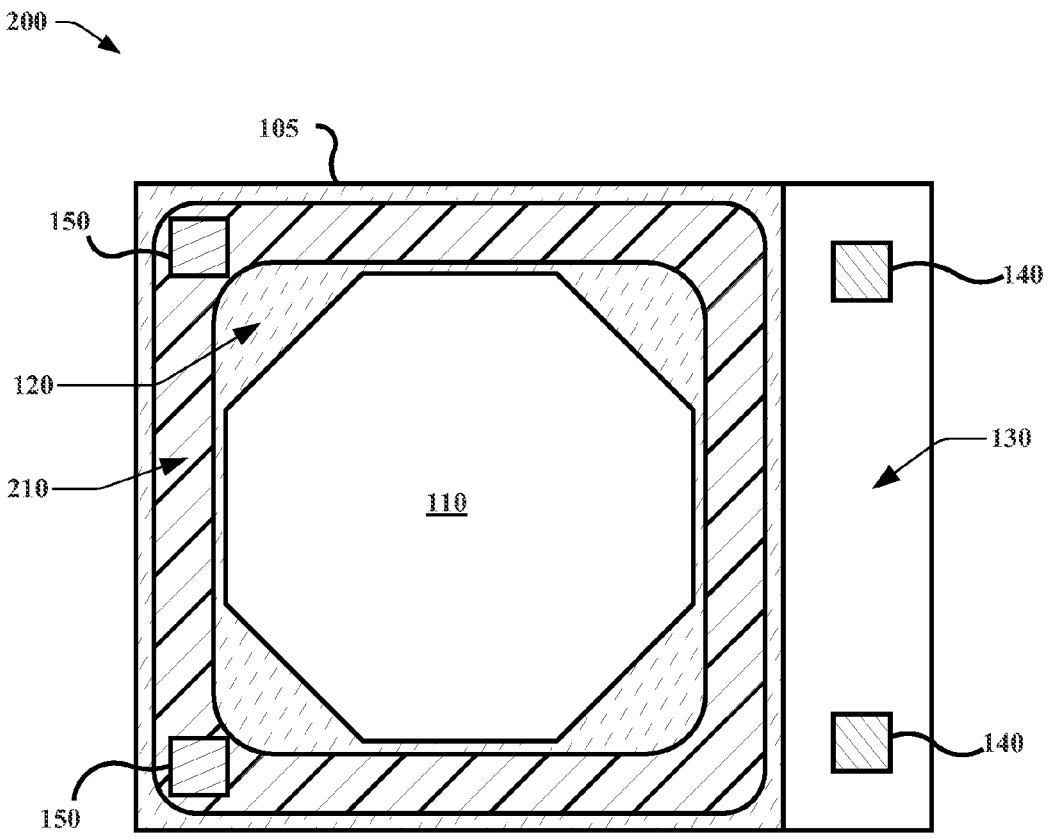
FIG. 2 illustrates a block diagram of a bottom view of a MEMS device including an acoustic seal, in accordance with various embodiments.

Aspects of the subject disclosure will now be described more fully hereinafter with reference to the accompanying drawings in which example embodiments are shown. In the following description, for purposes of explanation, numerous specific details are set forth in order to provide a thorough understanding of the various embodiments. However, the subject disclosure may be embodied in many different forms and should not be construed as limited to the example embodiments set forth herein.

Conventional MEMS device technologies secure a MEMS device, i.e., MEMS microphone, MEMS speaker, etc. to a die, e.g., substrate, printed circuit board (PCB), etc. by first bonding the MEMS device to the die and later placing a seal around the MEMS device. Consequently, such technologies reduce device assembly yields and lower device reliability as the seal can come in contact with and reduce functionality of membrane and electrical contact areas of the MEMS device. Various embodiments disclosed herein improve device reliability and improve assembly yields by applying an acoustic seal to an acoustic seal area of the MEMS device or an area of the substrate corresponding to the acoustic seal area before attachment of the MEMS device to the substrate. In this regard, in various embodiments disclosed herein, electrical connections and/or electrical contact points between the MEMS device and the die can be positioned in electrical interconnect area(s) that are outside of the acoustic seal area.

For example, a device can include a substrate, e.g., printed circuit board (PCB), etc., an acoustic seal, e.g., flexible acoustic seal, thixotropic adhesive material, bead of material, etc., and a micro-electro-mechanical system (MEMS) device, e.g., MEMS acoustic sensor, MEMS microphone, MEMS speaker, etc. The MEMS device can be mechanically attached to the substrate utilizing bond pad(s) that electrically couple, e.g., utilizing flip-chip bonding, etc. the MEMS device to the substrate and/or an application-specific integrated circuit (ASIC), e.g., at least partially embedded in the substrate. A portion of the MEMS device can include an acoustic area, e.g., including a diaphragm, a flexible membrane material, etc., an acoustic seal area surrounding the acoustic area and including the acoustic seal, and electrical interconnect area(s) including the bond pad(s)—the electrical interconnect area(s) located outside of the acoustic seal area.

In one embodiment, the acoustic seal can be compressed between the acoustic seal area and the substrate and/or the ASIC, e.g., during attachment of the MEMS device to the substrate. In another embodiment, the acoustic seal can be placed on the acoustic seal area or a portion of the substrate corresponding to the acoustic seal area as a high viscosity fluid, e.g., of a higher viscosity than water. Further, the acoustic seal can be cured, e.g., via heat, etc. after the MEMS device has been attached to the substrate. In this regard, the acoustic seal can define a gap between the MEMS device and the substrate and/or the ASIC. In another embodiment, mechanical support(s) can be attached to the acoustic seal area and/or the substrate to define the gap between the MEMS device and the substrate and/or the ASIC.

Another embodiment can include an electroacoustic package including a substrate, a flexible acoustic seal, e.g., a thixotropic adhesive material, etc. and an electroacoustic transducer, e.g., MEMS microphone, MEMS speaker, etc. including an acoustic area, e.g., comprising a diaphragm, etc., an acoustic seal area that surrounds the acoustic area and includes the flexible acoustic seal, and an electrical interconnect area that is located outside of the acoustic seal area and is attached to the substrate and/or an ASIC using bond pad(s).

In an embodiment, the flexible acoustic seal can be compressed between the acoustic seal area and the substrate and/or the ASIC, e.g., in response to the electrostatic transducer being attached to the substrate. In another embodiment, the flexible acoustic seal can be placed on the acoustic area, or a region of the substrate corresponding to the acoustic seal area, e.g., as a high viscosity fluid. In yet another embodiment, mechanical support(s) can be attached, within the acoustic seal area, to the substrate and/or the ASIC—the mechanical support(s) defining a gap between the electroacoustic transducer and the substrate and/or the ASIC. In other embodiments, the flexible acoustic seal can define the gap between the electroacoustic transducer and the substrate, e.g., without mechanical support(s) being placed, attached, etc. to the substrate and/or the ASIC.

In one embodiment, the bond pad(s) electrically couple the electroacoustic transducer to the substrate and/or the ASIC using solder balls. In another embodiment, the ASIC is at least partially embedded in the substrate, e.g., a PCB, and the bond pad(s) electrically couple the electrostatic transducer to the ASIC using the solder balls.

Yet another embodiment can include a method including placing bond pads(s) on an electrical interconnect area of a transducer, e.g., a MEMS microphone, a MEMS speaker, etc. —the electrical interconnect area located outside of an acoustic seal area of the transducer that surrounds an acoustic area of the transducer, and the transducer including, e.g., a diaphragm, a flexible membrane, etc. that is configured to convert sound vibrations into electrical signals or electrical signals into sound vibrations.

Further, the method can include placing an acoustic seal on the acoustic seal area of the transducer or a portion of a substrate corresponding to the acoustic seal area; attaching the bond pad(s) to the substrate and/or an ASIC; attaching the transducer to the substrate, e.g., utilizing flip-chip bonding, e.g., via solder, epoxy, Gold to Gold Interconnect (GGI), etc.; and curing the acoustic seal, e.g., using heat.

Reference throughout this specification to "one embodiment," or "an embodiment," means that a particular feature, structure, or characteristic described in connection with the embodiment is included in at least one embodiment. Thus, the appearances of the phrase "in one embodiment," or "in an embodiment," in various places throughout this specification are not necessarily all referring to the same embodiment. Furthermore, the particular features, structures, or characteristics may be combined in any suitable manner in one or more embodiments.

Furthermore, to the extent that the terms "includes," "has," "contains," and other similar words are used in either the detailed description or the appended claims, such terms are intended to be inclusive—in a manner similar to the term "comprising" as an open transition word—without precluding any additional or other elements. Moreover, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Furthermore, the word "exemplary" and/or "demonstrative" is used herein to mean serving as an example, instance, or illustration. For the avoidance of doubt, the subject matter disclosed herein is not limited by such examples. In addition, any aspect or design described herein as "exemplary" and/or "demonstrative" is not necessarily to be construed as preferred or advantageous over other aspects or designs, nor is it meant to preclude equivalent exemplary structures and techniques known to those of ordinary skill in the art.

Referring now to FIGS. 1-8, block diagrams (100, 200) of bottom views of MEMS device 105, e.g., an electroacoustic transducer, a microphone, a speaker, etc. and block diagrams (300, 400, 500, 600, 700, and 800) of cross sections of acoustic devices, packages, etc. including MEMS device 105 attached to substrate 310, and MEMS device 405 attached to substrate 310 are illustrated, respectively, in accordance with various embodiments. MEMS device 105 includes acoustic area 110, which includes a diaphragm/flexible membrane material 330, etc. configured to convert sound vibrations into electrical signals or electrical signals into sound vibrations. In one embodiment, opening 302, e.g., a port, etc. within substrate 310 is adapted to receive and/or transmit acoustic waves, e.g., acoustic pressure, sound pressure, etc. to/from a bottom portion, side, etc. of MEMS device 105.

Figure 3:
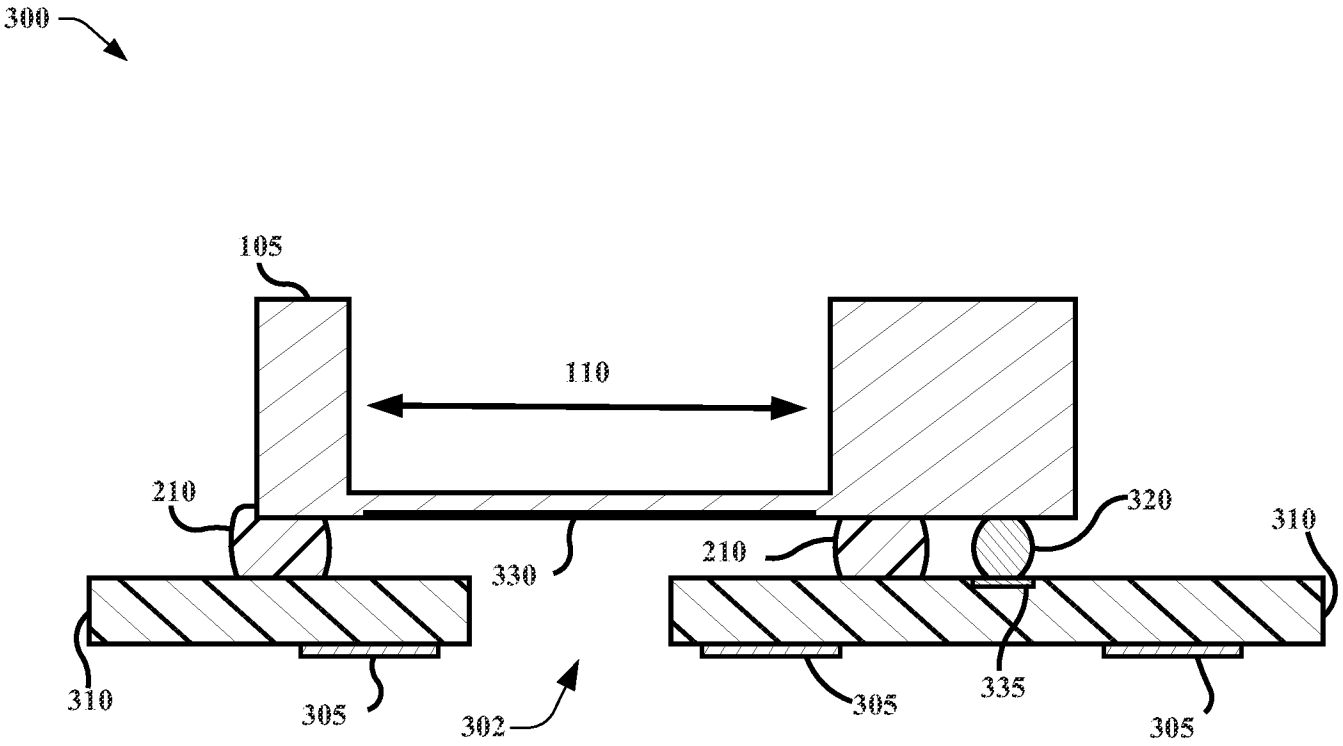
FIG. 3 illustrates a block diagram of a cross section of an acoustic device including a MEMS device without mechanical supports within an acoustic seal area, in accordance with various embodiments.
Figure 5:
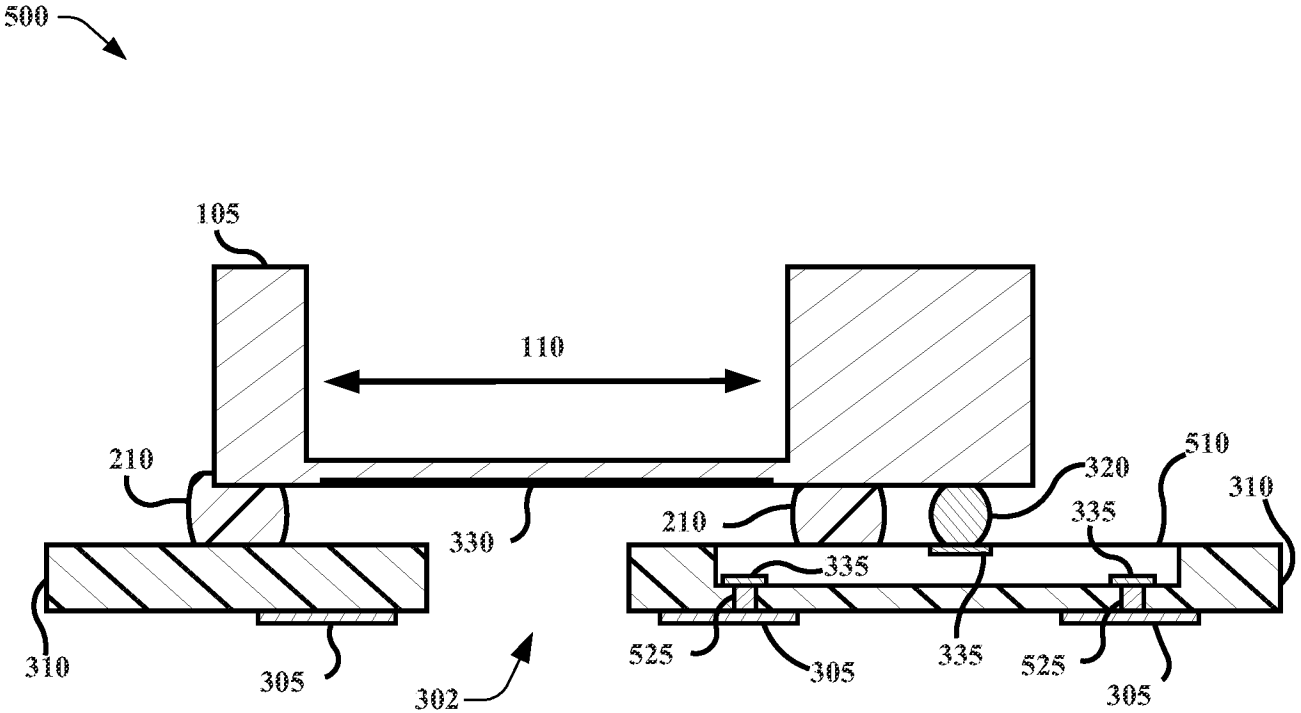
FIG. 5 illustrates a block diagram of a cross section of an acoustic device including a MEMS device that is attached to a substrate including an application-specific integrated circuit (ASIC), without mechanical supports within an acoustic seal area, in accordance with various embodiments.
Figure 6:
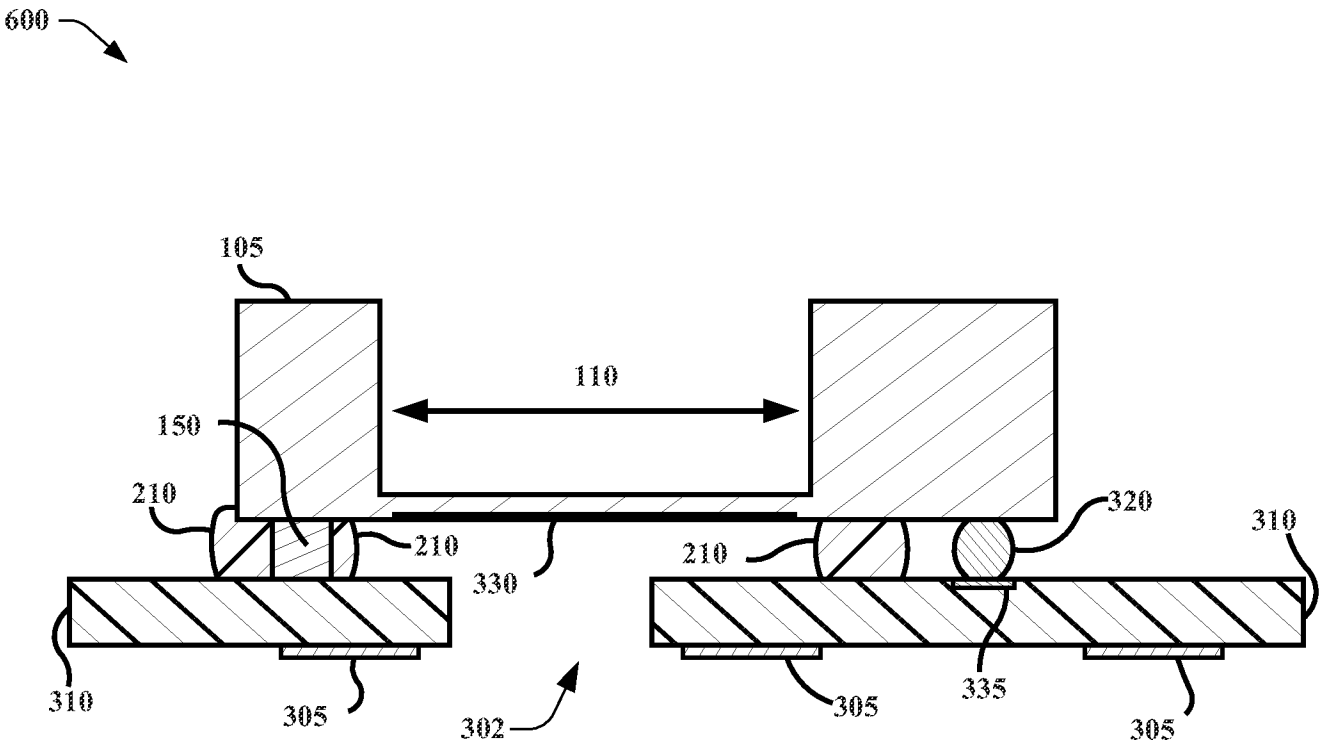
FIG. 6 illustrates a block diagram of a cross section of an acoustic package including a MEMS device with mechanical supports within an acoustic seal area, in accordance with various embodiments.
Figure 7:
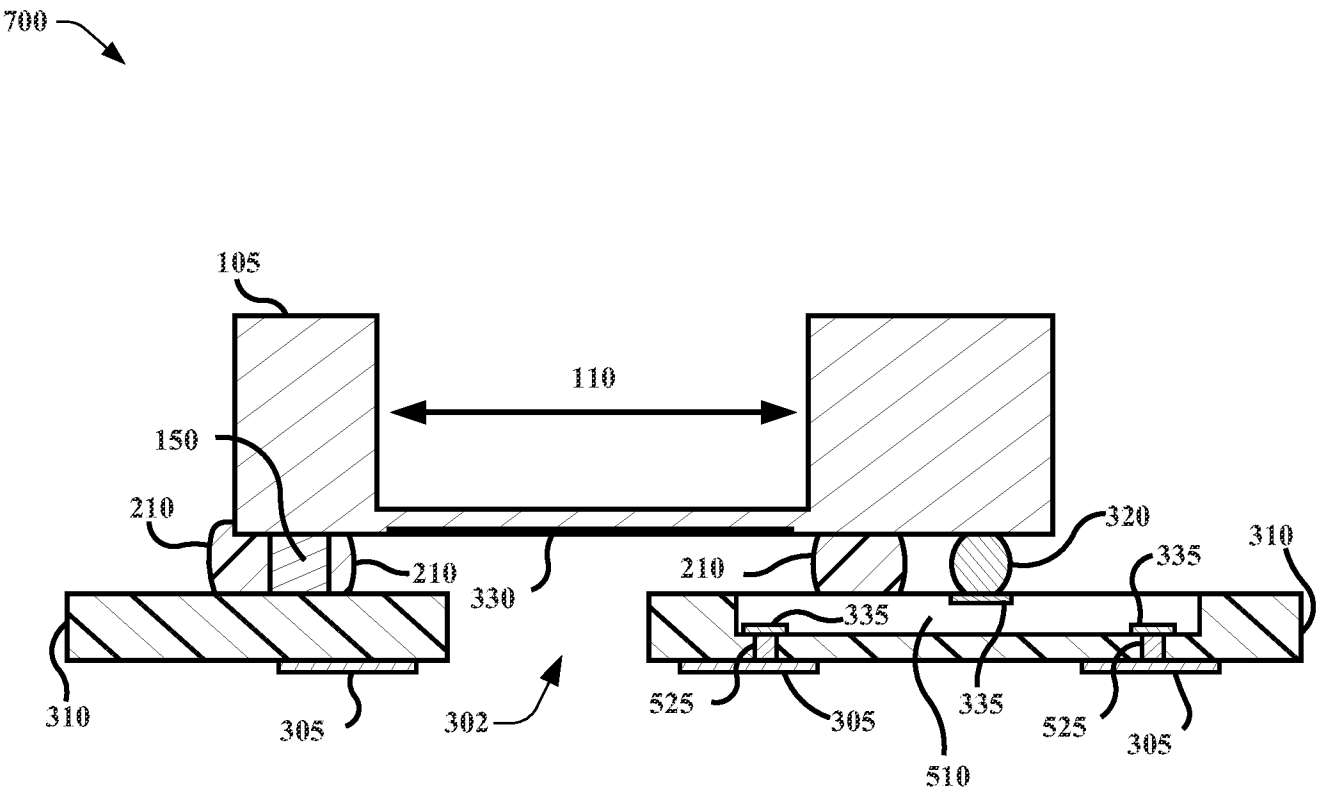
FIG. 7 illustrates a block diagram of a cross section of an acoustic package including a MEMS device that is attached to a substrate including an ASIC, with mechanical supports within an acoustic seal area, in accordance with various embodiments.
Figure 8:
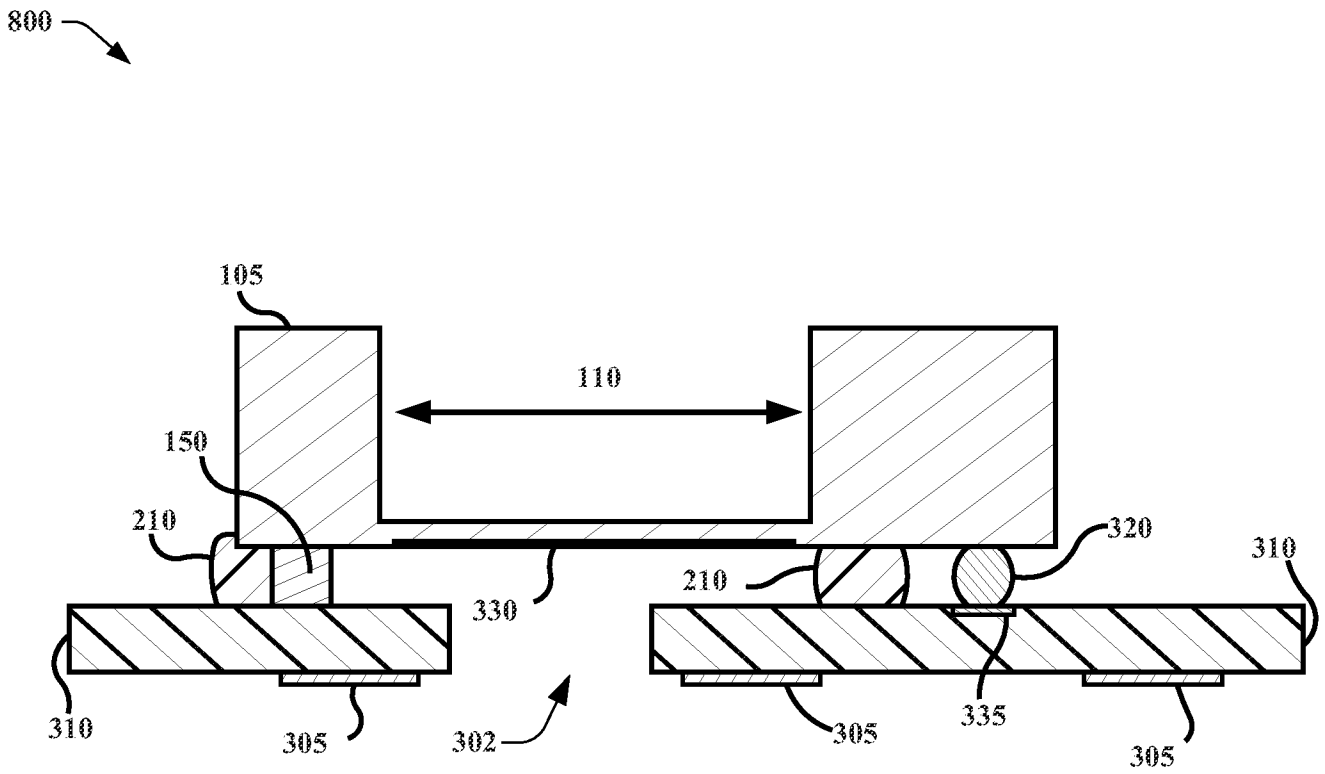
FIG. 8 illustrates a block diagram of a cross section of a package including a MEMS device with mechanical supports within an acoustic seal area without an acoustic seal on a portion of at least one of the mechanical supports, in accordance with various embodiments.

MEMS device 105 further includes acoustic seal area 120 that surrounds acoustic area 110, and electrical interconnect area 130 that is located outside of acoustic seal area 120 and includes bond pad(s) 140 that mechanically attach and electrically couple, e.g., via electrical contacts 335, MEMS device 105 to substrate 310 and/or ASIC 510, e.g., using solder ball(s) 320. In this regard, ASIC 510 can be communicatively, electrically, etc. coupled to MEMS device 105, e.g., via substrate 310, and include computing device(s), memory device(s), computing system(s), etc. for facilitating operation of MEMS device 105. As illustrated by FIGS. 3 and 5, electrical contacts 335, e.g., electronically coupled to ASIC 510, can be electrically coupled to electrical conductors 305 using vias 525.

Acoustic seal area 120 includes acoustic seal 210, e.g., a flexible acoustic seal such as a thixotropic adhesive material, etc. that can be placed on, dispensed on, adhered to, etc. acoustic seal area 120, (e.g., as a bead of material) before MEMS device 105 has been mechanically attached to substrate 310, or placed on, dispensed on, adhered to, etc. a portion of substrate 310 corresponding to acoustic seal area 120 of MEMS device 105, (e.g., as a bead of material) before MEMS device 105 has been mechanically attached to substrate 310. In this regard, in one embodiment, acoustic seal 210 can be compressed between acoustic seal area 120 and substrate 310 and/or ASIC 510, e.g., to isolate a volume of air corresponding to diaphragm/flexible membrane material 330 from another volume of air corresponding to outside portions of acoustic seal 210 and/or solder ball(s) 320. In another embodiment, acoustic seal 210 can be placed on acoustic seal area 120 or substrate 310 as a viscous fluid, e.g., of a higher viscosity than water, and later cured, e.g., via heat, after MEMS device 105 has been attached to substrate 310, e.g., to isolate the volume of air corresponding to the diaphragm/flexible membrane material 330 from the other volume of air corresponding to the outside portions of acoustic seal 210 and/or solder ball(s) 320.

Now referring to FIGS. 1-2 and 6-8, mechanical support(s) 150 can be attached to MEMS device 105 within acoustic seal area 120, and/or attached to portion(s) of substrate 310 corresponding to acoustic seal area 120. In this regard, mechanical support(s) 150 can be used to define a gap, space, etc. between MEMS device 105 and substrate 310 and/or ASIC 510 when MEMS device 105 has been attached to substrate 310. In one or more embodiments, mechanical support(s) 150 comprise a rigid material, e.g., a semiconductor, a non-conductive insulator, a metal, which can be attached to, fixed to, formed on, grown on, acoustic seal area 120 and/or the portions(s) of substrate 310 corresponding to acoustic seal area 120 to define the gap and/or space. In embodiments illustrated by FIGS. 2, 6, 7, and 8, mechanical support(s) 150 are included within and/or contact acoustic seal 210. In an embodiment illustrated by FIG. 8, acoustic seal 210 does not contact exposed side(s) of at least one mechanical support of mechanical support(s) 150. In this regard, in one or more embodiments, acoustic seal 210 can surround, e.g., as a semi-viscous fluid, one or more portions of mechanical support(s) 150.

In other embodiments illustrated by FIGS. 3 and 5, MEMS device 105 and/or substrate 310 do not include mechanical support(s) 150. In this regard, acoustic seal 210 can be utilized to define the gap, space, etc. between MEMS device 105 and substrate 301 and/or ASIC 510. For example, acoustic seal 210 can be placed on acoustic seal area 120 or substrate 310 as a high viscosity fluid, e.g., of a viscosity higher than water, that maintains the gap between MEMS device 105 and substrate 301 and/or ASIC 510. Further, acoustic seal 210 can be cured, e.g., via heat, after MEMS device 105 has been attached to substrate 310.

Figure 4:
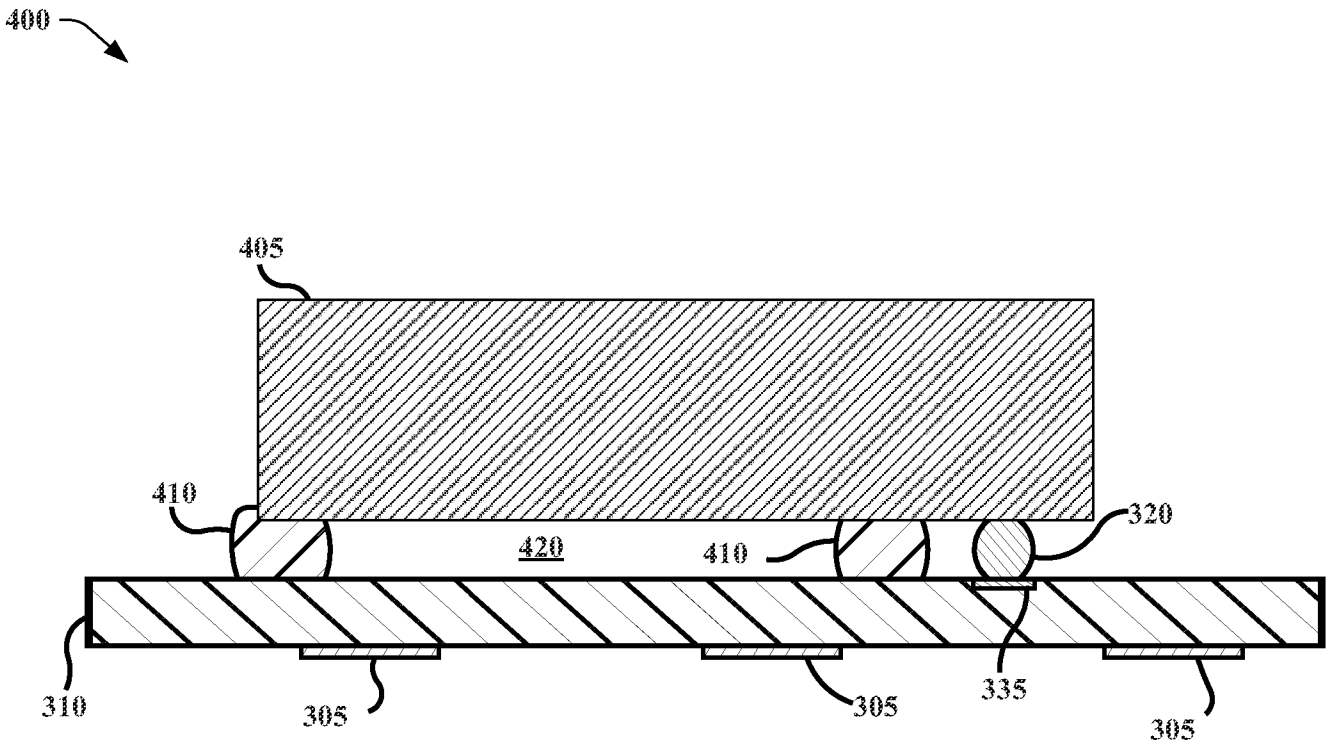
FIG. 4 illustrates a block diagram of a cross section of a MEMS device, in accordance with various embodiments.

Now referring to FIG. 4, a block diagram 400 of a cross section of MEMS device 405 is illustrated, in accordance with various embodiments. MEMS device 405 can comprise a device that is not primarily intended to respond to acoustic signals, e.g., such as a navigation device, a gyroscope, an optical device, a microscope, a pneumatic based device, a biological based device. Further, MEMS device can 405 can include a seal area (not shown) that is similar to acoustic seal area 120, and an electrical interconnect area (not shown) that is similar to electrical interconnect area 130. The electrical interconnect area is located outside of the seal area and includes bond pad(s) (not shown) similar to bond pad(s) 140 that mechanically attach and electrically couple, e.g., via electrical contacts 335, MEMS device 405 to substrate 310 using solder ball(s) 320.

The seal area includes seal 410, e.g., a flexible acoustic seal such as a thixotropic adhesive material, which can be placed on, dispensed on, adhered to the seal area, (e.g., as a bead of material) before MEMS device 405 has been mechanically attached to substrate 310, or placed on, dispensed on, adhered to, a portion of substrate 310 corresponding to the seal area of MEMS device 405, (e.g., as a bead of material) before MEMS device 405 has been mechanically attached to substrate 310. In this regard, in one embodiment, seal 410 can be compressed between the seal area and substrate 310 and/or an ASIC (not shown) that is similar to ASIC 510, e.g., to isolate, seal, free space 420, e.g., adjacent to MEMS device 405, from other areas, regions, corresponding to outside portions of seal 410 and/or solder ball(s) 320. For example, in one embodiment, MEMS device 405 can include a microfluidic based device in which free space 420 includes a medium other than air.

In another embodiment, seal 410 can be placed on the seal area or substrate 310 as a viscous fluid, e.g., of a higher viscosity than water, and later cured, e.g., via heat, after MEMS device 405 has been attached to substrate 310, e.g., to isolate, seal, free space 420 from the other areas, regions corresponding to the outside portions of seal 410 and/or solder ball(s) 320. In other embodiment(s) (not shown), free space 420 can be coupled to an opening (not shown) in substrate 310 that is similar to opening 302.

In yet other embodiments (not shown), mechanical support (s) 150 can be attached to MEMS device 405 within the seal area, and/or attached to portion(s) of substrate 310 corresponding to the seal area. In this regard, mechanical support (s) 150 can be used to define a gap, space between MEMS device 405 and substrate 310 and/or the ASIC when MEMS device 405 has been attached to substrate 310. In one or more embodiments, mechanical support(s) 150 comprise a rigid material, e.g., a semiconductor, a non-conductive insulator, a metal, which can be attached to, fixed to, formed on, grown on, the seal area and/or the portions(s) of substrate 310 corresponding to the seal area to define the gap, space. In other embodiments (not shown), mechanical support(s) 150 are included within and/or contact seal 410. In another embodiment (not shown), seal 410 does not contact exposed side(s) of at least one mechanical support of mechanical support(s) 150. In this regard, in one or more embodiments, seal 410 can surround, e.g., as a semi-viscous fluid, one or more portions of mechanical support(s) 150.

Figure 9:
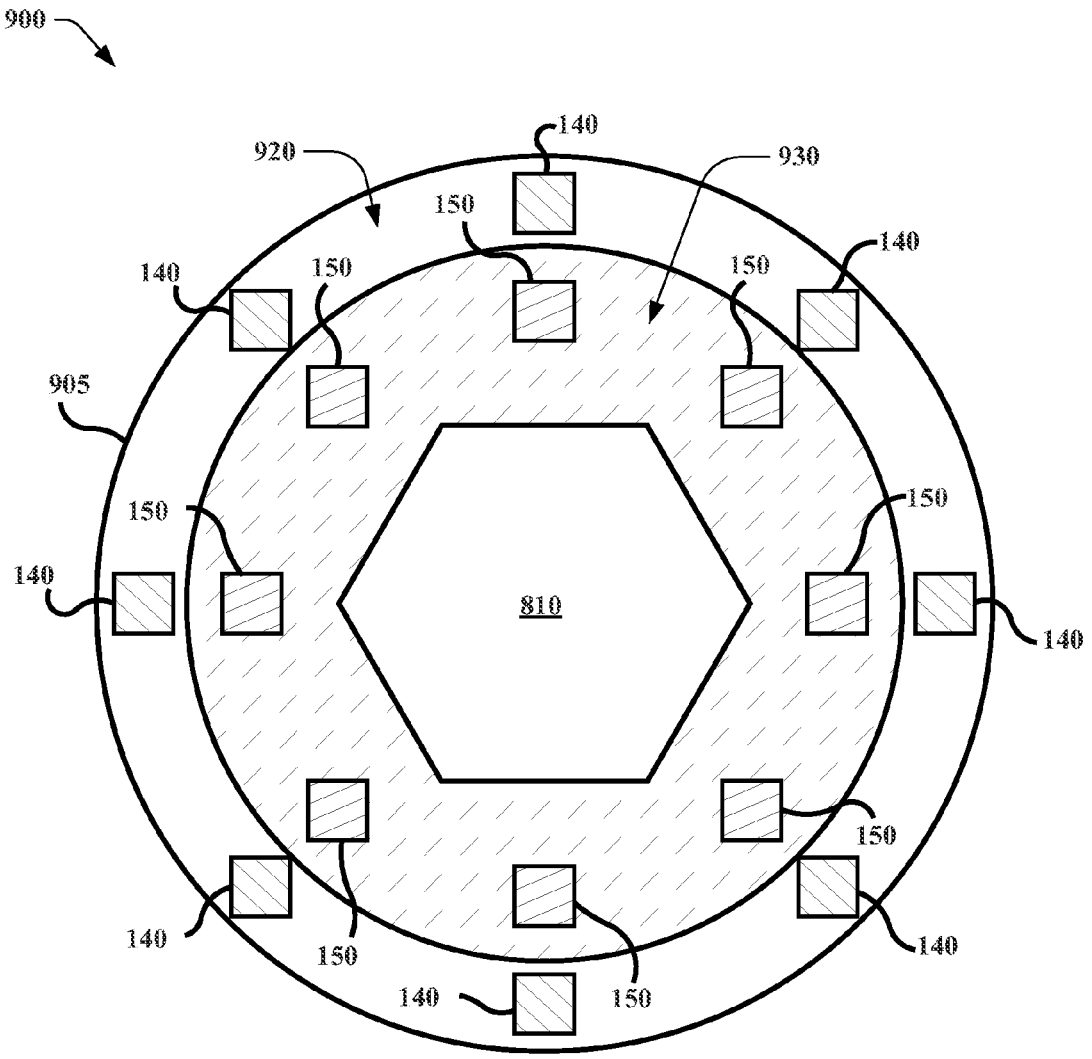
FIG. 9 illustrates a block diagram of a bottom portion of another MEMS device, in a accordance with various embodiments.
Figure 10:
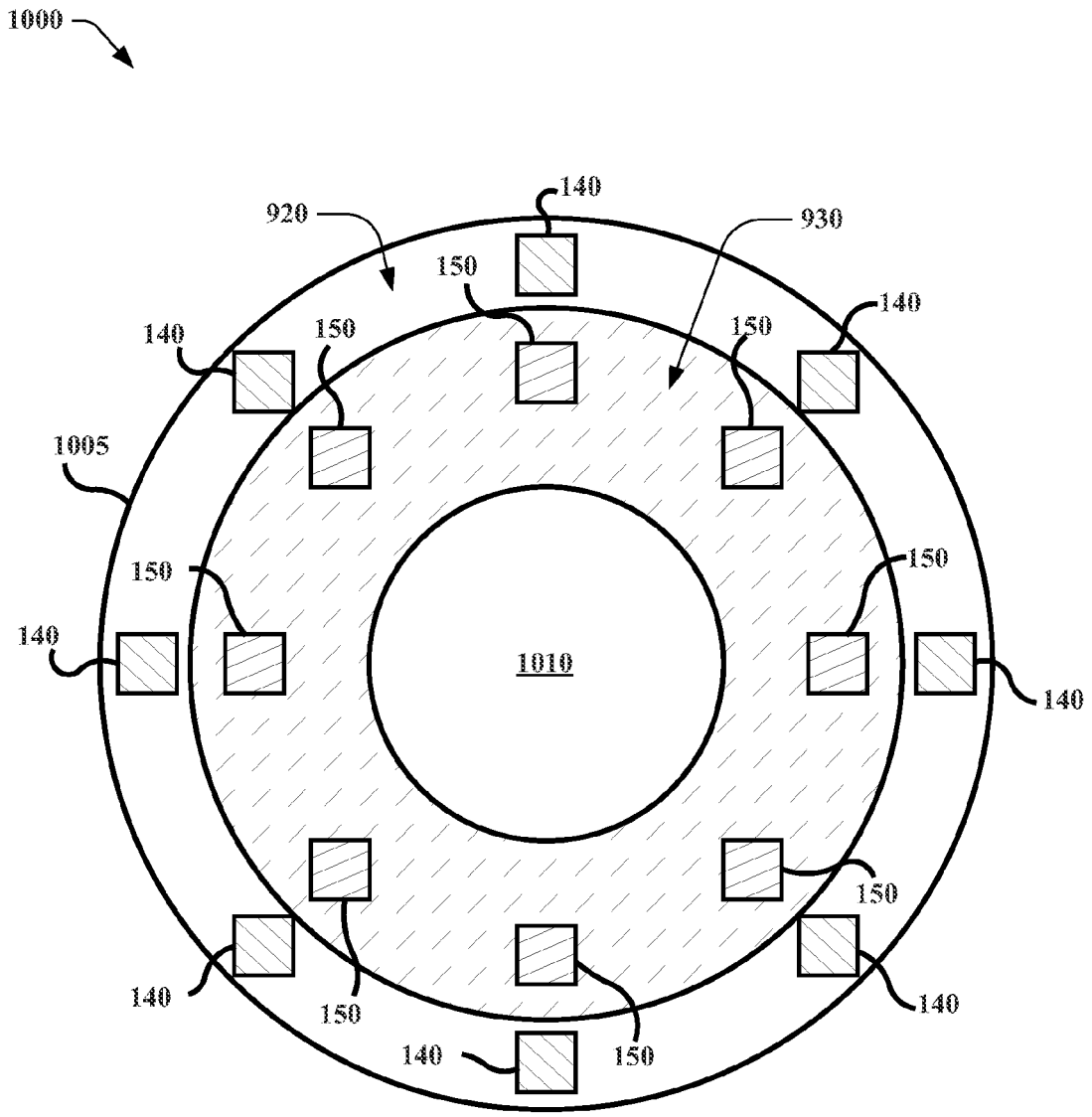
FIG. 10 illustrates a block diagram of a bottom portion of yet another MEMS device, in accordance with various embodiments.
Figure 11:
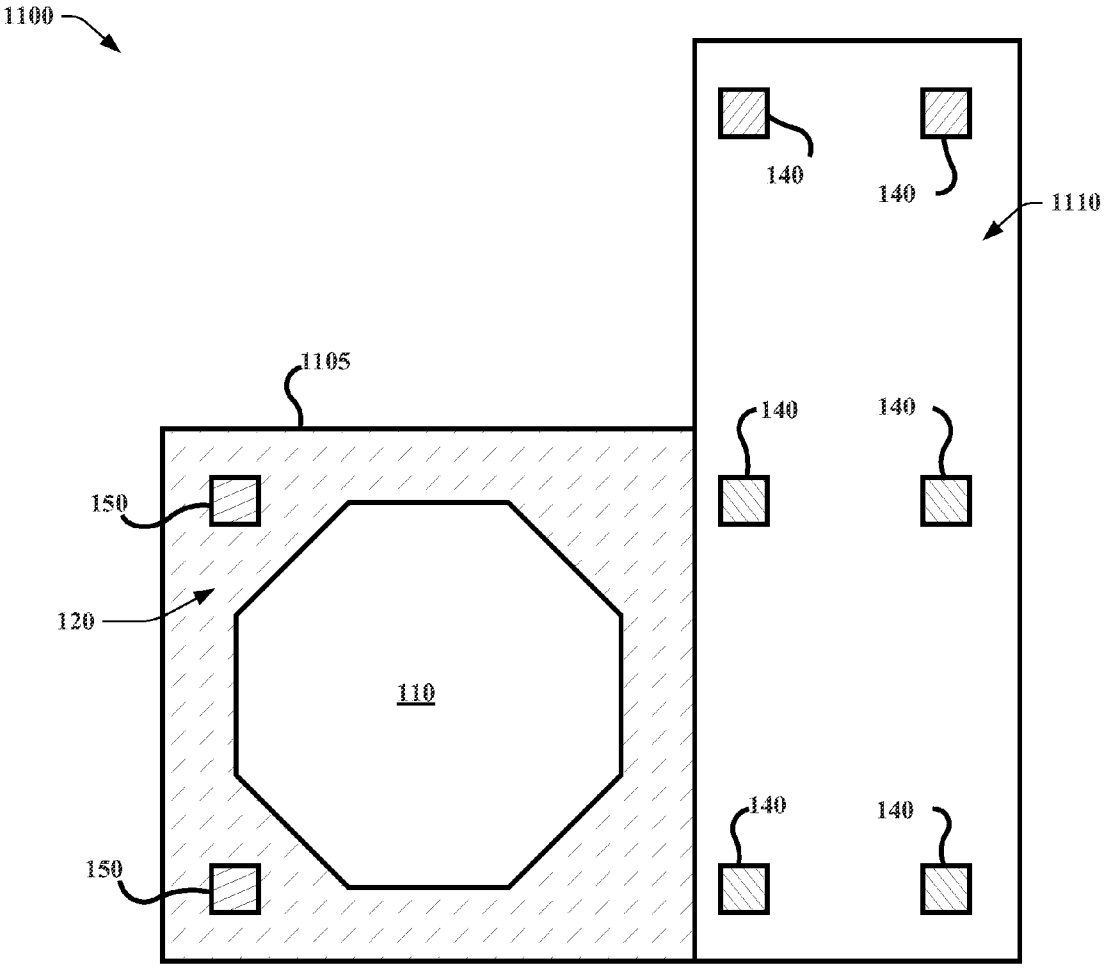
FIG. 11 illustrates a block diagram of a bottom portion of a MEMS device of an irregular polygon shape, in accordance with various embodiments.

Referring now to FIGS. 9-11, block diagrams of bottom portions of MEMS devices of a circular shape and an irregular polygon shape are illustrated, respectively, in accordance with various embodiments. In this regard, it should be appreciated by a person of ordinary skill in MEMS technologies that embodiments of MEMS devices disclosed herein can comprise various shapes, comprise acoustic seal areas of various shapes surrounding acoustic areas of various shapes, and electrical interconnect areas of various shapes located outside of such acoustic seal areas. Further, embodiments of MEMS devices disclosed herein can include any number of mechanical support(s) 150 and/or bond pad(s) 140.

As illustrated by FIG. 9, MEMS device 905 can include regular polygon acoustic area 910, e.g., including diaphragm/flexible membrane material 330 (not shown) configured to convert sound vibrations into electrical signals or electrical signals into sound vibrations, surrounded by circular acoustic seal area 930. Circular acoustic seal area 930 includes mechanical support(s) 150 positioned around circular acoustic seal area 930, e.g., to define a gap between MEMS device 905 and a substrate (not shown), e.g., 310, after MEMS device 905 has been attached to the substrate. Although not illustrated, acoustic seal 210 can be placed within circular acoustic seal area 930, or a portion of the substrate corresponding to circular acoustic seal area 930, before MEMS device 905 has been attached to the substrate. In other embodiment(s) (not shown), circular acoustic seal area 930 does not include mechanical support(s) 150, and acoustic seal 210 can define the gap between MEMS device 905 and the substrate, e.g., after being cured via heat.

MEMS device 905 further includes circular electrical interconnect area 920 that surrounds circular acoustic seal area 930. Circular electrical interconnect area 920 includes bond pad(s) 140 positioned around circular electrical interconnect area 920, e.g., for forming electrical contacts and bonding, attaching, etc. MEMS device 905 to the substrate.

Referring now to FIG. 10, MEMS device 1005 can include circular acoustic area 1010, e.g., including diaphragm/flexible membrane material 330 (not shown) configured to convert sound vibrations into electrical signals or electrical signals into sound vibrations, surrounded by circular acoustic seal area 930. Circular acoustic seal area 930 includes mechanical support(s) 150 positioned around circular acoustic seal area 930, e.g., to define a gap between MEMS device 1005 and a substrate (not shown), e.g., 310, after MEMS device 1005 has been attached to the substrate. Although not illustrated, acoustic seal 210 can be placed within circular acoustic seal area 930, or a portion of the substrate corresponding to circular acoustic seal area 930, before MEMS device 1005 has been attached to the substrate. In other embodiment(s) (not shown), circular acoustic seal area 930 does not include mechanical support(s) 150, and acoustic seal 210 can define the gap between MEMS device 1005 and the substrate, e.g., after being cured via heat.

As illustrated by FIG. 11, MEMS device 1105 can include acoustic area 110, e.g., including diaphragm/flexible membrane material 330 (not shown) configured to convert sound vibrations into electrical signals or electrical signals into sound vibrations, surrounded by acoustic seal area 120. Acoustic seal area 120 can include acoustic seal 210 (not shown), e.g., a flexible acoustic seal, (e.g., a thixotropic adhesive material), that can be placed on, dispensed on, adhered to, etc. acoustic seal area 120 (e.g., as a bead of material), before MEMS device 1105 has been mechanically attached to a substrate (not shown), e.g., 310. In another embodiment, acoustic seal 210 can be placed on, dispensed on, adhered to, etc. a portion of the substrate corresponding to acoustic seal area 120 of MEMS device 1105, e.g., as a bead of material, before MEMS device 1105 has been mechanically attached to the substrate.

Mechanical support(s) 150 can be attached to MEMS device 1005 within acoustic seal area 120, and/or attached to portion(s) of the substrate corresponding to acoustic seal area 120. In this regard, mechanical support(s) 150 can be used to define a gap, space, etc. between MEMS device 1105 and the substrate when MEMS device 1105 has been attached to the substrate 310. In one embodiment (not shown), mechanical support(s) 150 can be included within and/or contact acoustic seal 210. In another embodiment (not shown), acoustic seal 210 does not contact exposed side(s) of at least one mechanical support of mechanical support(s) 150. In this regard, in one or more embodiments, acoustic seal 210 can surround, e.g., as a semi-viscous fluid, one or more portions of mechanical support(s) 150.

MEMS device 1105 further includes electrical interconnect area 1110 that is located outside of acoustic seal area 120 and includes bond pad(s) 140 that mechanically attach and electrically couple, e.g., via electrical contacts 335 (not shown), MEMS device 1105 to the substrate, e.g., using solder ball(s) 320 (not shown).

Figure 12:
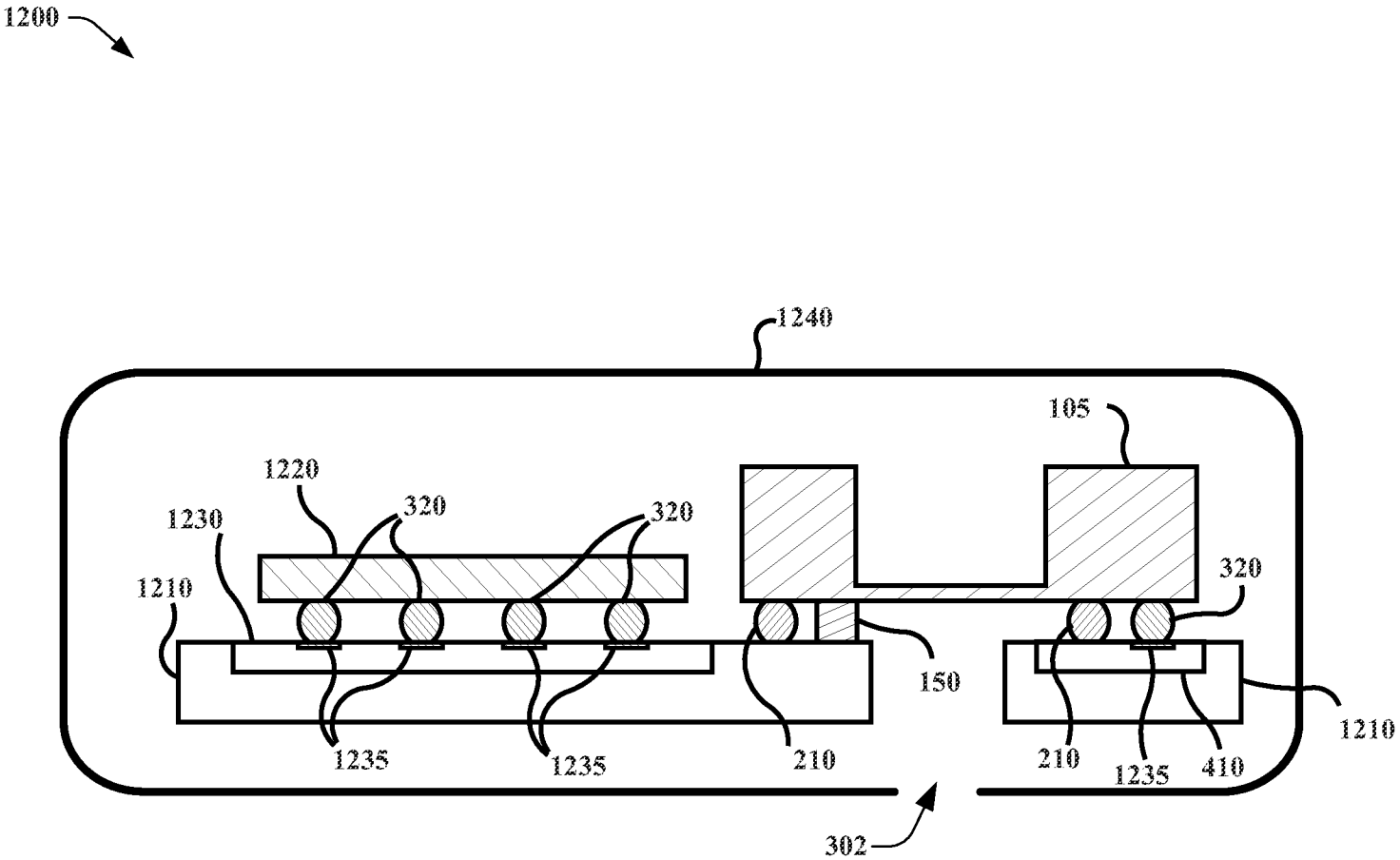
FIG. 12 illustrates a block diagram of a system including a MEMS device, in accordance with various embodiments.

FIG. 12 illustrates a block diagram of system 1200, e.g., a portable computing device, a smartphone, a cellular device, a wireless computing device, a wireless communication device, a handheld computing device, a recording device, a sound playback device, etc. including MEMS device 105, in accordance with various embodiments. Enclosure 1240 of system 1200 can include opening 302, e.g., port, etc. configured to couple acoustic pressure, sound waves, etc. to/from MEMS device 105. Further, ASIC 510, ASIC 1220, and ASIC 1230, can include computing device(s), memory device(s), computing system(s), etc. for facilitating operation of system 1200, can be included within or attached to substrate 1210, e.g., a PCB, and can be communicatively coupled, electrically coupled, etc. to MEMS device 105, e.g., via electrical contacts 1235 using solder ball(s) 320. In other embodiments (not shown), MEMS device 105 can be communicatively coupled, electrically coupled, etc to other substrates, devices, etc. (not shown) included within system 1200.

Figure 13:
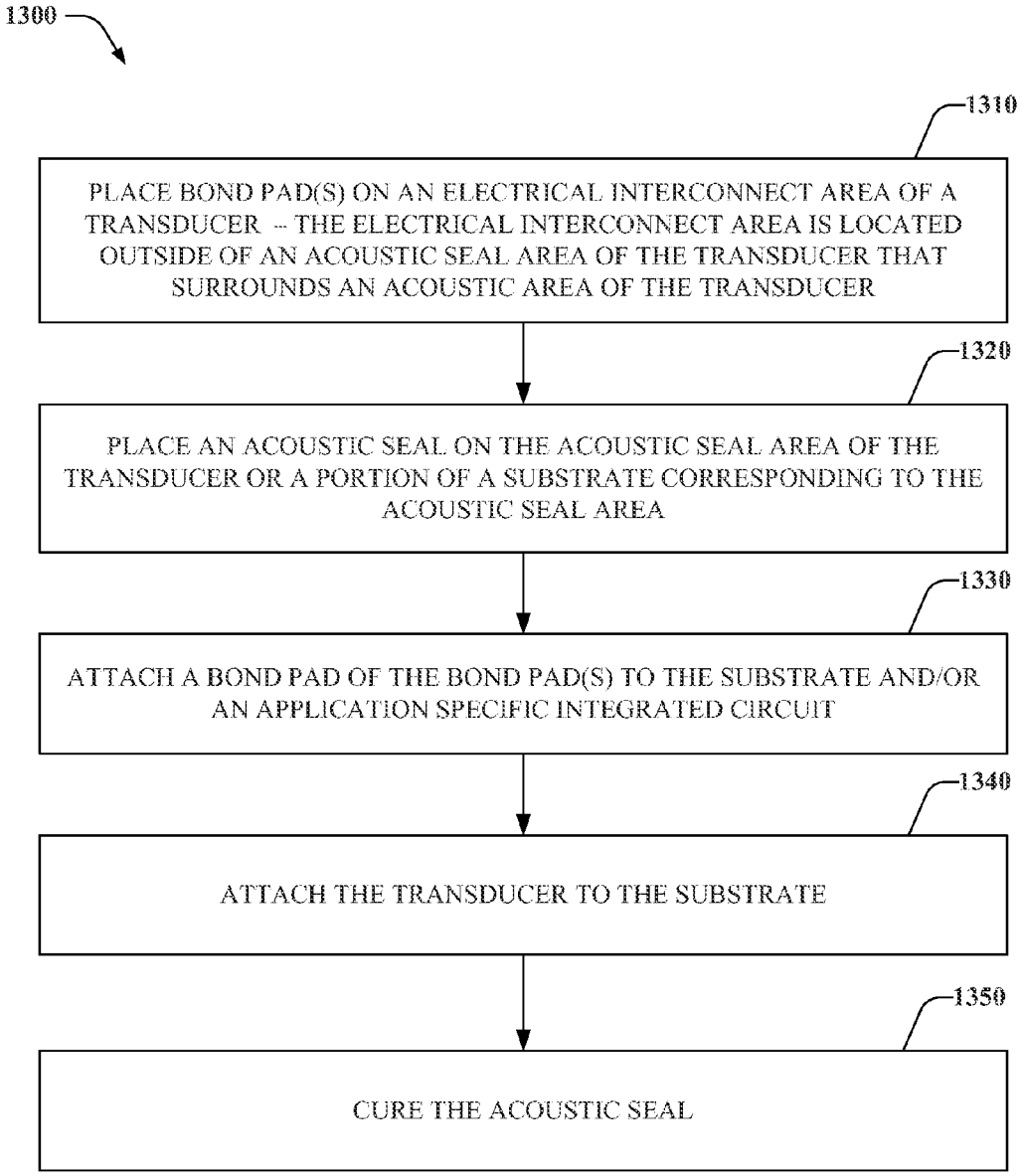
FIG. 13 illustrates a flow diagram of a method for assembling a MEMS device, in accordance with various embodiments.

Referring now to FIG. 13, a flow diagram of a method (1300) for assembling an acoustic device including a MEMS device, e.g., MEMS device 105, is illustrated, in accordance with various embodiments. The order in which some or all of the process blocks appear in method 1300 should not be deemed limiting. Rather, it should be understood by a person of ordinary skill in MEMS technologies having the benefit of the instant disclosure that some of the process blocks can be executed in a variety of orders not illustrated. At 1310, bond pad(s) can be placed on an electrical interconnect area of a transducer, e.g., MEMS microphone, MEMS speaker, etc. The electrical interconnect area is located outside of an acoustic seal area of the transducer that surrounds an acoustic area of the transducer that includes, e.g., a diaphragm, a flexible membrane, etc. that is configured to convert sound vibrations into electrical signals or electrical signals into sound vibrations.

At 1320, an acoustic seal can be placed on the acoustic seal area of the transducer or a portion of a substrate corresponding to the acoustic seal area. At 1330, the bond pad(s) can be attached to the substrate and/or an ASIC, e.g., the ASIC least partially embedded in the substrate. At 1340, the transducer can be attached to the substrate, e.g., utilizing flip-chip bonding, (e.g., via solder, epoxy, GGI). At 1350, the acoustic seal can be cured, e.g., via heat.

The above description of illustrated embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize.

In this regard, while the disclosed subject matter has been described in connection with various embodiments and corresponding Figures, where applicable, it is to be understood that other similar embodiments can be used or modifications and additions can be made to the described embodiments for performing the same, similar, alternative, or substitute function of the disclosed subject matter without deviating therefrom. Therefore, the disclosed subject matter should not be limited to any single embodiment described herein, but rather should be construed in breadth and scope in accordance with the appended claims below.

What is claimed is:

1. A device comprising:

a substrate;

an acoustic seal; and a micro-electro-mechanical system (MEMS) device mechanically attached to the substrate utilizing at least one bond pad that electrically couples the MEMS device to at least one of the substrate or an application-specific integrated circuit (ASIC), wherein a portion of the MEMS device comprises an acoustic area, an acoustic seal area that surrounds the acoustic area and includes the acoustic seal, and at least one electrical interconnect area that is located outside of the acoustic seal area and comprises the at least one bond pad.

2. The device of claim 1, wherein the acoustic seal has been compressed between the acoustic seal area and the at least one of the substrate or the ASIC.

3. The device of claim 2, wherein the acoustic seal comprises a thixotropic adhesive material.

4. The device of claim 1, further comprising:

at least one mechanical support that is attached to at least one of the acoustic seal area or the substrate, wherein the at least one mechanical support defines a gap between the MEMS device and the at least one of the substrate or the ASIC.

5. The device of claim 1, wherein the ASIC is at least partially embedded in the substrate.

6. The device of claim 1, wherein the substrate is a printed circuit board (PCB).

7. The device of claim 1, wherein the at least one bond pad electrically couples the MEMS device to the at least one of the substrate or the ASIC utilizing flip-chip bonding.

8. The device of claim 1, wherein the acoustic area comprises a diaphragm.

9. The device of claim 8, wherein the MEMS device comprises a MEMS microphone or a MEMS speaker.

10. An electroacoustic package, comprising:

a substrate;

a flexible acoustic seal; and an electroacoustic transducer comprising an acoustic area, an acoustic seal area that surrounds the acoustic area and includes the acoustic seal, and an electrical interconnect area that is located outside of the acoustic seal area and is attached to at least one of the substrate or an application-specific integrated circuit (ASIC) using at least one bond pad.

11. The electroacoustic package of claim 10, wherein the flexible acoustic seal is compressed between the acoustic seal area and the at least one of the substrate or the ASIC.

12. The electroacoustic package of claim 10, wherein the flexible acoustic seal comprises a thixotropic adhesive material.

13. The electroacoustic package of claim 10, further comprising:

at least one mechanical support that is attached, within the acoustic seal area, to the at least one of the substrate or the ASIC and defines a gap between the electroacoustic transducer and the at least one of the substrate or the ASIC.

14. The electroacoustic package of claim 10, wherein the at least one bond pad electrically couples the electroacoustic transducer to the at least one of the substrate or the ASIC using solder balls.

15. The electroacoustic package of claim 10, wherein the ASIC is at least partially embedded in the substrate.

16. The electroacoustic package of claim 10, wherein the substrate is a printed circuit board (PCB).

17. The electroacoustic package of claim 10, wherein the acoustic area comprises a diaphragm.

18. The electroacoustic package of claim 10, wherein the electroacoustic transducer comprises a microelectromechanical system (MEMS) microphone.

19. The electroacoustic package of claim 10, wherein the electroacoustic transducer comprises a microelectromechanical system (MEMS) speaker.

20. A method, comprising:

placing one or more bond pads on an electrical interconnect area of a transducer, wherein the electrical interconnect area is located outside of an acoustic seal area of the transducer, and wherein the acoustic seal area surrounds an acoustic area of the transducer;

placing an acoustic seal on the acoustic seal area of the transducer or a portion of a substrate corresponding to the acoustic seal area;

attaching a bond pad of the one or more bond pads to at least one of the substrate or an application-specific integrated circuit (ASIC);

attaching the transducer to the substrate; and curing the acoustic seal.

21. The method of claim 20, wherein the attaching the transducer to the substrate comprises attaching the transducer to the substrate utilizing flip-chip bonding.

22. The method of claim 20, wherein the transducer comprises a microelectromechanical (MEMS) microphone.

23. The method of claim 20, wherein the transducer comprises a microelectromechanical (MEMS) speaker.

* * * * *